US008595977B2

(12) United States Patent
Hancock et al.

(10) Patent No.: US 8,595,977 B2
(45) Date of Patent: Dec. 3, 2013

(54) DRIVING SYSTEM FOR AN AUTOMATIC SLIDING DOOR

(75) Inventors: Mark Steven Hancock, Cecil Hill (AU); Tim Gulliver, Wollongong (AU)

(73) Assignee: Autoslide Pty Ltd, Wetherill Park, NSW (AU)

( * ) Notice: Subject to any disclaimer, the term of this patent is extended or adjusted under 35 U.S.C. 154(b) by 296 days.

(21) Appl. No.: 12/847,976

(22) Filed: Jul. 30, 2010

(65) Prior Publication Data

US 2012/0023827 A1 Feb. 2, 2012

(51) Int. Cl.
*E05F 15/14* (2006.01)

(52) U.S. Cl.
USPC ..... 49/349; 49/348; 49/362; 49/360; 49/25; 49/26; 49/28

(58) Field of Classification Search
USPC ..... 49/25, 26, 28, 348, 349, 362, 360, 324; 74/422, 89.17
See application file for complete search history.

(56) References Cited

U.S. PATENT DOCUMENTS

| | | | | |
|---|---|---|---|---|
| 1,997,175 | A * | 4/1935 | Gussack | 49/100 |
| 2,458,669 | A | 1/1949 | Yeamans | |
| 2,871,009 | A * | 1/1959 | Picatti | 49/30 |
| 3,819,177 | A | 6/1974 | Spiro | |
| 4,823,010 | A * | 4/1989 | Kornbrekke et al. | 250/341.7 |
| 5,142,152 | A * | 8/1992 | Boiucaner | 250/341.7 |
| 5,351,441 | A | 10/1994 | Hormann | |
| 5,589,747 | A * | 12/1996 | Utke | 318/468 |
| 5,839,394 | A | 11/1998 | Dickison | |
| 6,918,210 | B1 | 7/2005 | Smiley | |
| 2008/0104780 | A1 * | 5/2008 | Dayton et al. | 15/22.1 |
| 2008/0163553 | A1 * | 7/2008 | Liao | 49/362 |
| 2008/0244978 | A1 * | 10/2008 | Soyugenc | 49/42 |

FOREIGN PATENT DOCUMENTS

| | | | |
|---|---|---|---|
| CN | 201206388 | Y | 3/2009 |
| GB | 872980 | A | 7/1961 |
| JP | H04-6477 | U | 1/1992 |
| WO | 2004/073153 | A2 | 8/2004 |

OTHER PUBLICATIONS

International Preliminary Report on Patentability for counterpart International Patent Application No. PCT/US2011/000964.

* cited by examiner

*Primary Examiner* — Katherine Mitchell
*Assistant Examiner* — Marcus Menezes
(74) *Attorney, Agent, or Firm* — David N. Lathrop

(57) ABSTRACT

A driving system for an automatic sliding door includes a driver and a rack and pinion mechanism. The pinion is selectively attachable to the driver in a first position to cause sliding movement of the door in the first direction and in a second position to cause sliding movement of the door in the second direction. A device for indicating whether a driving system is suitable for driving a sliding door includes a first end, a region including one or more calibrations; and a second end. The first end is adapted to be pulled by a user. The second end is adapted to be selectively and detachably attached to one of the calibrations. The region is located between the first end and the second end.

18 Claims, 8 Drawing Sheets

DRIVING SYSTEM FOR AN AUTOMATIC SLIDING DOOR

TECHNICAL FIELD

The present invention relates broadly to a driving system for an automatic sliding door. The present invention also relates to a device for indicating whether a driving system is suitable for driving a sliding door.

BACKGROUND ART

There is a general desire in the sliding door industry to provide a driving system which may be installed or retrofitted into any existing sliding doors or windows regardless of their style and geometry.

It is also generally desired to be able to avoid overloading of a driving system for automatic sliding doors, as it is rather expensive and time consuming to repair an overloaded system.

It is an object of the present invention to provide a driving system which may fulfil the above desire or which may at least provide a useful alternative.

SUMMARY OF THE INVENTION

According to a first aspect of the present invention, there is provided a driving system for an automatic sliding door, the driving system including:

a driver; and a pinion adapted to cause sliding movement of the door in a first or second direction when operatively connected to a corresponding rack associated with the door, the pinion being selectively attachable to the driver in two positions:

(a) a first position in order to cause sliding movement of the door in the first direction; and (b) a second position in order to cause sliding movement of the door in the second direction.

Preferably, the door is made of a panel or glass pane framed by a top rail and two side stiles. An upper portion of the panel or the top rail of the glass pane is preferred to be held in place by a guard. The guard is typically attached to a ceiling. More preferably the driver includes a motor and a gearbox.

In a preferred embodiment, the rack is adapted to be connected to the upper portion of the panel or the top rail of the glass pane via a connector. This is most suitable for a patio door with a glass pane framed by a standard sized top rail and for a cavity door having a carriage which hangs off a runner attached to the guard. The connector is preferred to be a channel adapted to span a gap between the door and the driver. The channel may generally be L-shaped in cross section. Optionally, the channel also has an open-ended elongate cavity.

The driving system may include one or more caps adapted to fit onto one or more ends of the channel. Preferably, the each cap includes at least one hole for receiving a fixing means such as a screw.

Alternatively, in the case of patio door having a frame with a short top rail, the rack may be affixed to the side stiles or one or more grab stiles which extend from the side stiles.

Preferably, the second direction is a reverse of the first direction.

In a preferred embodiment, the driving system includes a member adapted to complementarily fit onto the connector. The member is preferred to be a concealer adapted to bridge a gap between a lower end of the driver and the door.

It is preferred that the driver is operatively connected to a coding device. Preferably, the coding device is remotely controllable. The coding device is preferred to be capable of causing the sliding door to operate in any selected one of four modes. The first (automatic) mode may involve the sliding door operating in response to one or more sensors located internally and/or externally of the door opening. The second (lock) mode may involve locking the sliding door in a closed position by way of an internal locking mechanism. The internal locking mechanism may form an integral part of or be associated with the motor. Preferably the internal locking mechanism is remotely controllable. The third (hold open) mode may involve maintaining the sliding door in an open position. The fourth (pet) mode may involve enabling the coding device to respond to presence of a pet thereby causing the sliding door to operate in the one or more states.

Conveniently, the coding device is associated with another coding device connected to another movable object. This is most suitable for, for example, a patio door which is accompanied by a fly screen. Preferably, the coding devices are configured such that they are capable of being set to operate in a master and slave arrangement. As such, motions of the patio door and a complementary fly screen may be synchronised.

The coding device is adapted to respond to an activator including an infrared (IR) emitter for emitting an IR beam to an object and a sensor adapted to detect a reflected beam from the object. Preferably, the activator is movably connected to a holder adapted to be affixed to the door guard, a wall or ceiling. The holder is preferred to include a back plate and a pair of ratchet bars extending therefrom. Preferably the ratchet bars are curved with sloping teeth. In this embodiment, the emitting angle of the IR beam is dictated by the orientation of the activator thereby defining an area of operation. The movement of the activator is preferably coordinated with the pair of ratchet bars. The activator may be locked at a desired position by a selected pair of sloping teeth provided on the ratchet bars.

According to a second aspect of the present invention, there is provided a device for indicating whether a driving system is suitable for driving a sliding door, the device including:

a first end adapted to be pulled by a user;

a region including one or more calibrations; and a second end adapted to be selectively and detachably attached to one of the calibrations; the region being located between the first end and the second end.

The first end is preferred to include a loop adapted to be held by a user. The calibrations are chosen in accordance with loads acceptable to particular driving system, including the driving system of the first aspect of the invention.

Preferably, the calibrated region is at least in part fabricated of a looped portion of VELCRO™, a hooked portion of VELCRO™ being fixed to the second end, or vice versa. Other attachment method may be used instead.

In use, the user attaches the device to an attachment means, such as a handle on the door, attaches the second end to a desired calibration and use the first end to pull the door in a selected direction. If the second end detaches from the desired calibration during this procedure, this is an indication that the driving system is not suitable for driving the sliding door. In such a case, the user may select a heavier duty driving system for example.

Optionally, the device of the second aspect may be used to indicate whether the driving system of the first aspect is suitable for driving the sliding door.

BRIEF DESCRIPTION OF THE DRAWINGS

In order to achieve a better understanding of the nature of the present invention, non-limiting preferred embodiments of the invention will now be described, by way of example only, with reference to the accompanying drawings, in which.

DETAILED DESCRIPTION

It will be appreciated that the driving system of the present invention is preferably designed specifically for use domestically. Although the driving system may include a more powerful motor to drive sliding doors in large scale commercial buildings, adaptations of other components may be required.

Figure 1:
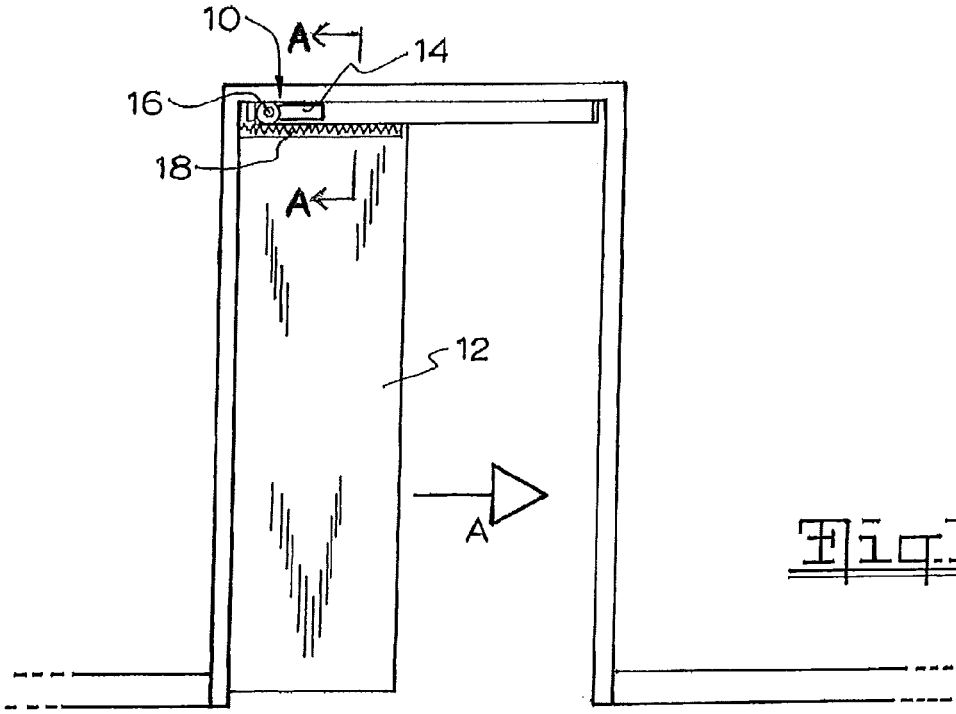
FIG. 1 is a side elevation of a driving system in accordance with one preferred embodiment of the present invention, installed in such a way that the door is movable in one direction.
Figure 2:
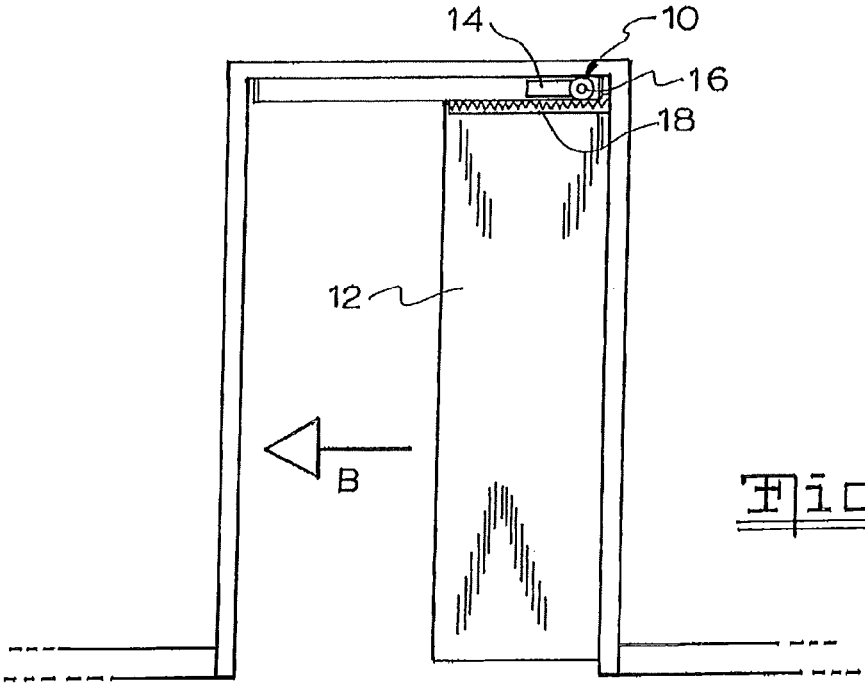
FIG. 2 is a side elevation of the driving system of FIG. 1 installed in such a way that the door is movable in an opposite direction.

Referring to FIGS. 1 and 2, a driving system 10 for an automatic sliding door 12 includes a driver 14 and a pinion 16. The pinion 16 in combination with a corresponding rack 18 can cause sliding movement of the door 12 in a first (closing) direction indicated by A (FIG. 1) or a second (reverse) direction indicated by B (FIG. 2) when operatively connected to the corresponding rack 18 associated with the door 12. In each case, the closing direction may be reversed to cause the door 12 to open. The driver 14 includes a motor and a gearbox which are not shown.

Figure 3:
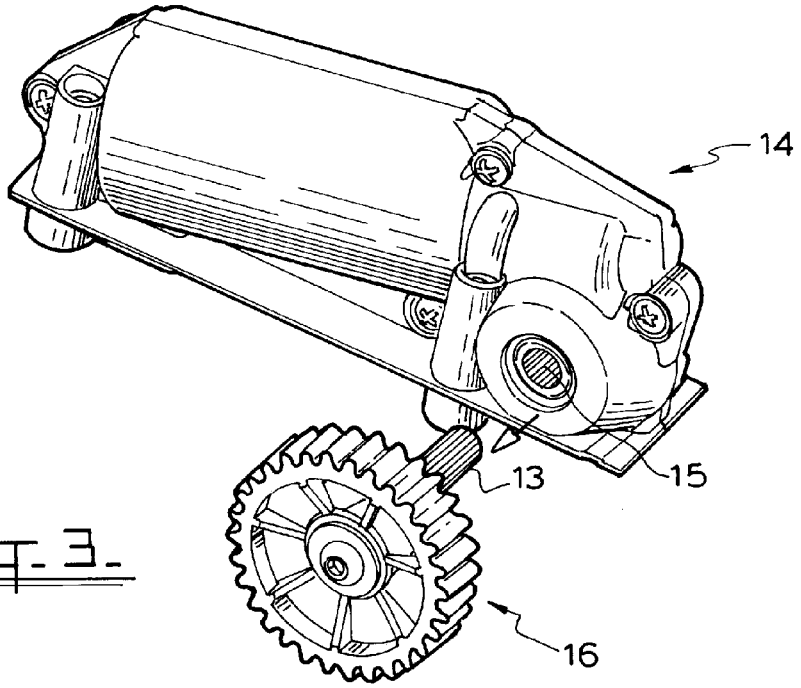
FIG. 3 is a partially exploded perspective view of an embodiment of the driving system of the invention, showing the driver and pinion arranged in one position.
Figure 4:
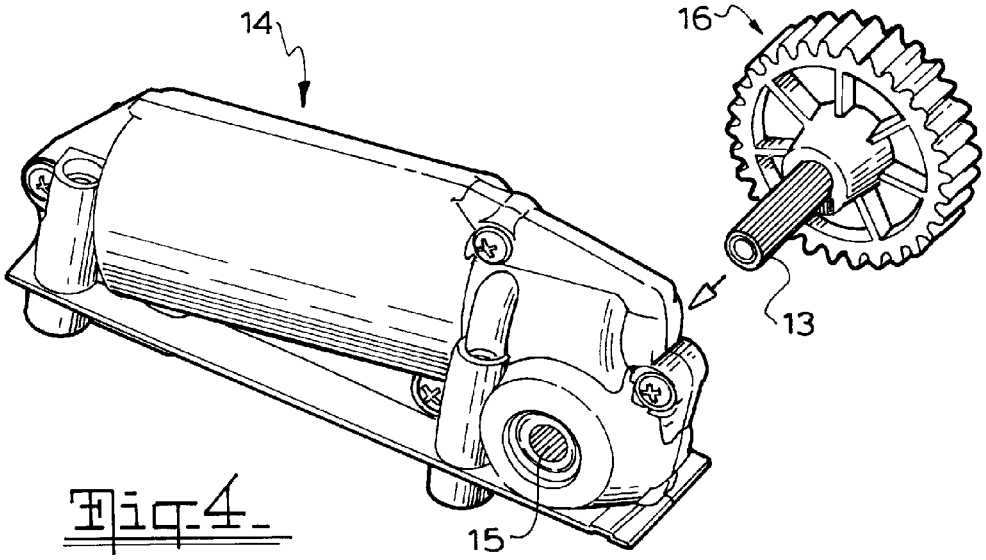
FIG. 4 is a partially exploded perspective view of the driving system of FIG. 3, showing driver and pinion arranged in another position.

As best shown in FIGS. 3 and 4, the pinion 16 is selectively attachable to the driver 14 in two positions. The first position as illustrated in FIG. 3 is adopted to cause sliding movement of the door 12 in the first direction A. By contrast, the second position shown in FIG. 4 is adopted to cause sliding movement of the panel in the second direction B.

The pinion 16 has a shaft 13 which is received in a hollow 15 provided in the driver 14. A bolt (not shown) is provided to secure the shaft 13 of the pinion 16 in place within the hollow 15.

Figure 9:
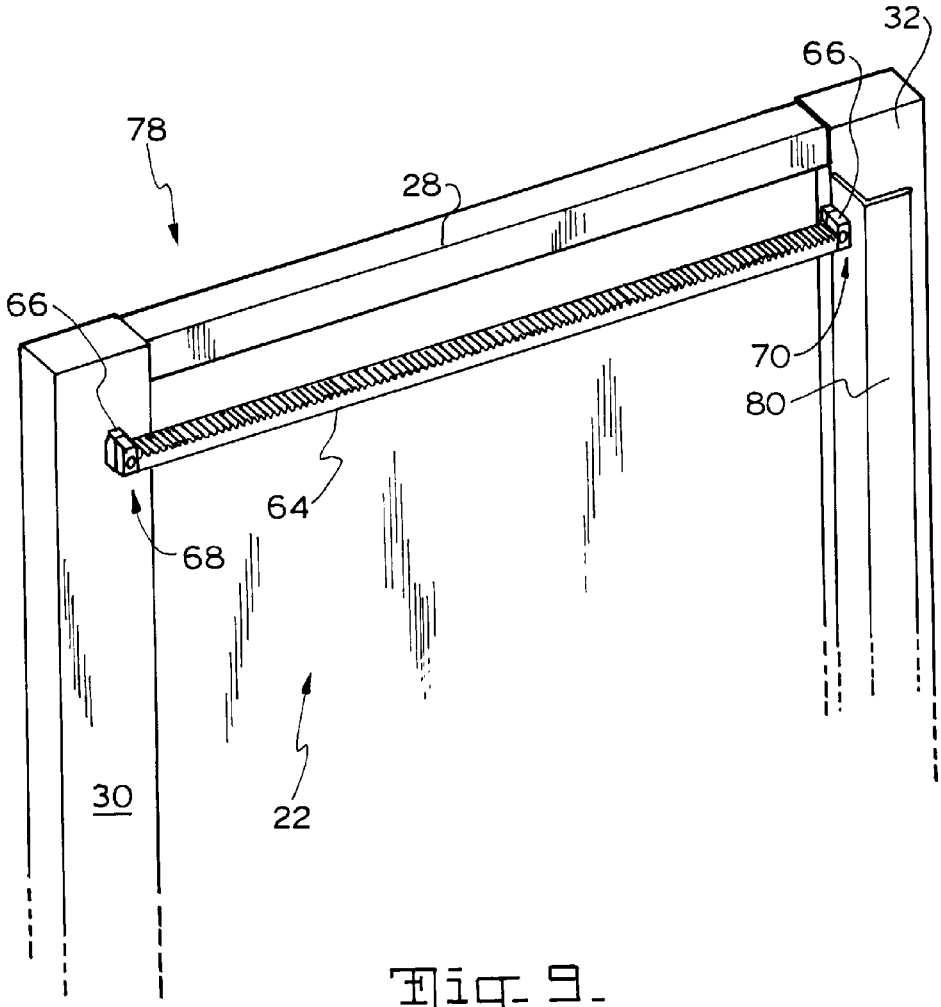
FIG. 9 is a perspective view of a patio door stile on which a rack is mounted for coordination with the driving system of FIG. 3 or 4.

Turning to FIGS. 5 to 7 and 9, the door 12 in different embodiments may be made of a panel 20 or glass pane 22 framed by a top rail 24 (FIG. 5), 26 (FIG. 6) or 28 (FIG. 9) and two side stiles 30 and 32 (FIG. 9). An upper portion 34 of the panel (FIG. 7) or the top rail 24, 26 or 28 of the glass pane 22 (FIGS. 5, 6 and 9) is held in place by a guard 36, 38 or 40, respectively. The guard 36, 38 or 40 is attached to a ceiling 42.

Figure 5:
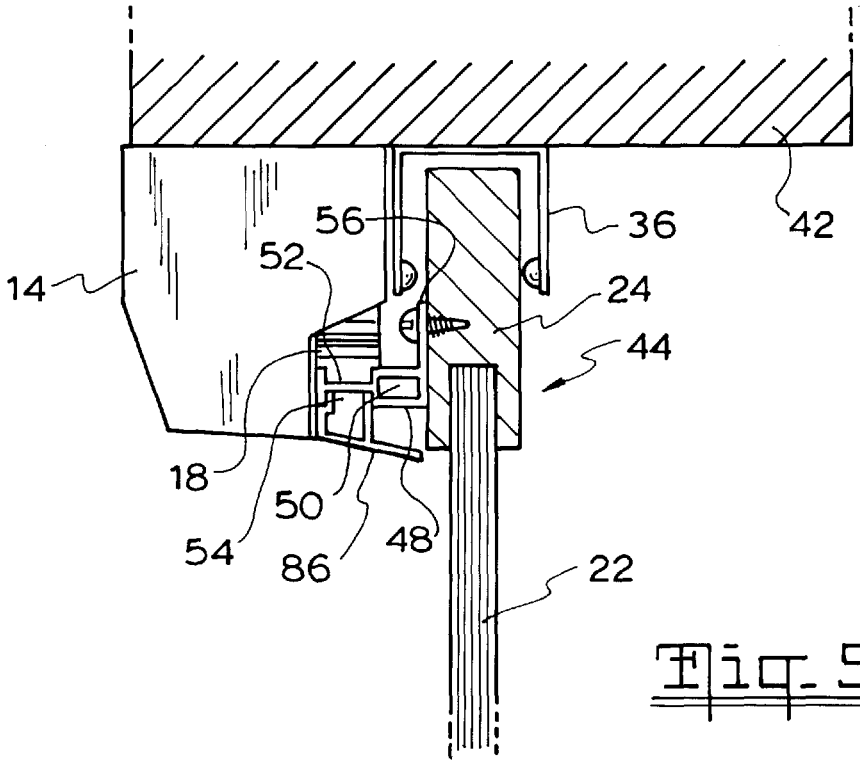
FIG. 5 is a cross sectional view taken along the line A-A of the driving system of FIG. 1 mounted on a patio door with a short top rail.
Figure 6:
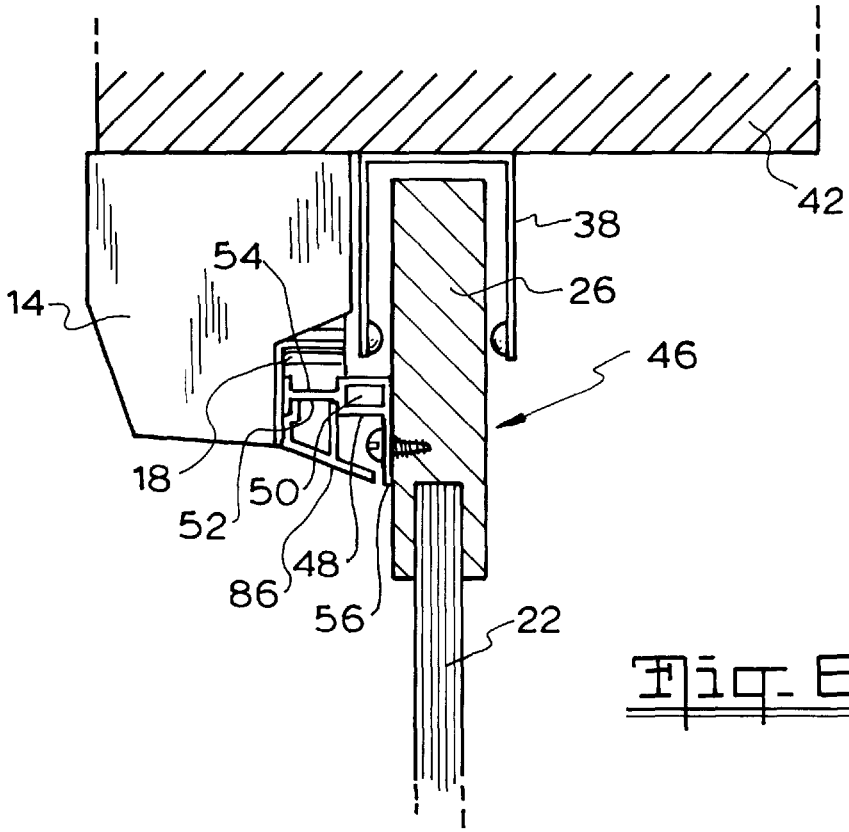
FIG. 6 is across sectional view taken along the line A-A of the driving system of FIG. 1 mounted on a patio door with a tall top rail.
Figure 7:
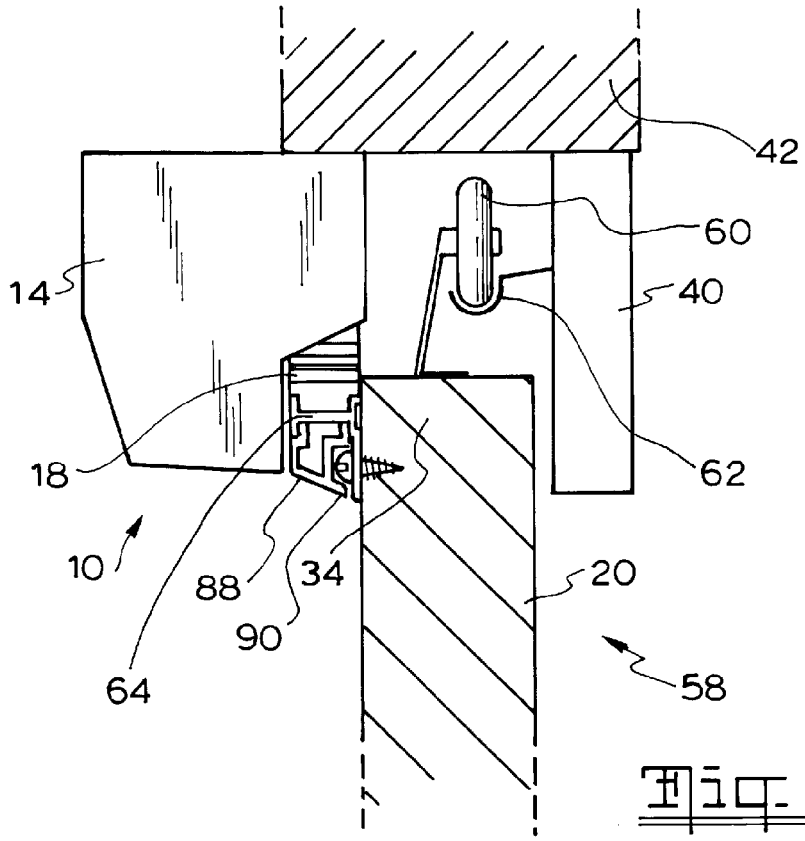
FIG. 7 is a cross sectional view taken along the line A-A of the driving system of FIG. 1 mounted on a cavity door.

Referring to FIGS. 5 and 6, patio doors 44 and 46 both include a glass pane 22 partially framed by the top rail 24 and 26, respectively. In both embodiments, the rack 18 is connected to the top rail 24 or 26 of the glass pane 22 via a connector. The connector is in the form of a channel 48 having a generally L-shaped cross section. The channel 48 spans a gap between the patio door 44, 46 and the driver 14. The channel 48 also has an open-ended elongate cavity 50 and two grooves 52 and 54. It can be observed that the top rail 24 of patio door 44 (FIG. 5) is shorter than that 26 of patio door 46. For this reason, the channel 48 is disposed with its vertical wall 56 facing up when the top rail 24 is short (FIG. 5) and turned up-side-down when the top rail 24 is tall (FIG. 6). The channel 48 shown in FIGS. 5 and 6 are most suitable for the patio doors 44 and 46, each having a glass pane 22 framed by a standard sized top rail. As shown in FIGS. 5 and 6, a member in the form of an extrusion 86 is provided to fit onto the connector for aesthetic purposes. Likewise, another embodiment of the member 88 is fitted onto the channel 64 as shown in FIG. 7. The member 88 includes an extension 90 which conceals a screw.

Turning to FIG. 7, the driving system 10 is connected to a cavity door 58 which consists of panel 20. In this embodiment, the rack 18 is connected to the upper portion 34 of the panel 20 via a connector in the form of a channel 64, except that this channel 64 does not have the open-ended cavity 50 present in FIGS. 5 and 6. The cavity door 58 is supported by a carriage 60 which hangs off a runner 62 attached to the guard 40.

Figure 8:
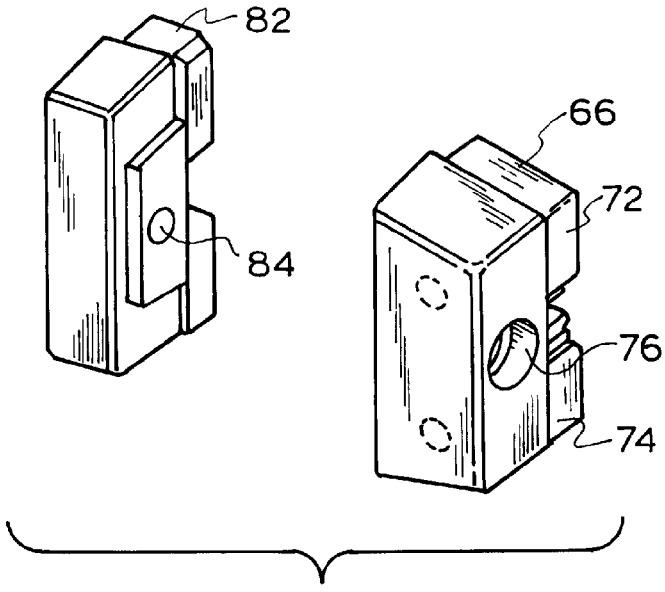
FIG. 8 is a perspective view of a cap and a corresponding packer.

As shown in FIGS. 8 and 9, a cap 66 is provided to fit onto each of the ends 68 and 70 of the channel 64. The cap 66 has protrusions 72 and 74 for engaging the groove 52, 54 (FIGS. 5 and 6) of the channel 64. It will be appreciated that the cap 66 can also be used to fit onto the ends of channel 48 (FIGS. 5 and 6). As best shown in FIG. 8, the cap 66 has a hole 76 for receiving a fixing means such as a screw (not shown). The cap 66 is configured such that fixing can be effected either at right angle or parallel to the face of the glass pane 22.

Referring to FIGS. 8 and 9, another embodiment of a patio door 78 has a frame with a very short top rail 28. In this case, the rack 64 has one end affixed to side stile 30 and the other end affixed to a grab stile 80 which extends from the side stile 32. A packer 82 (FIG. 8) is provided between the cap 66 and the stile 30. The packer 82 also has a hole 84 for receiving the screw. The packer 82 is configured to couple snugly with cap 66 for securing the rack 64 to the stile 30.

Figure 10:
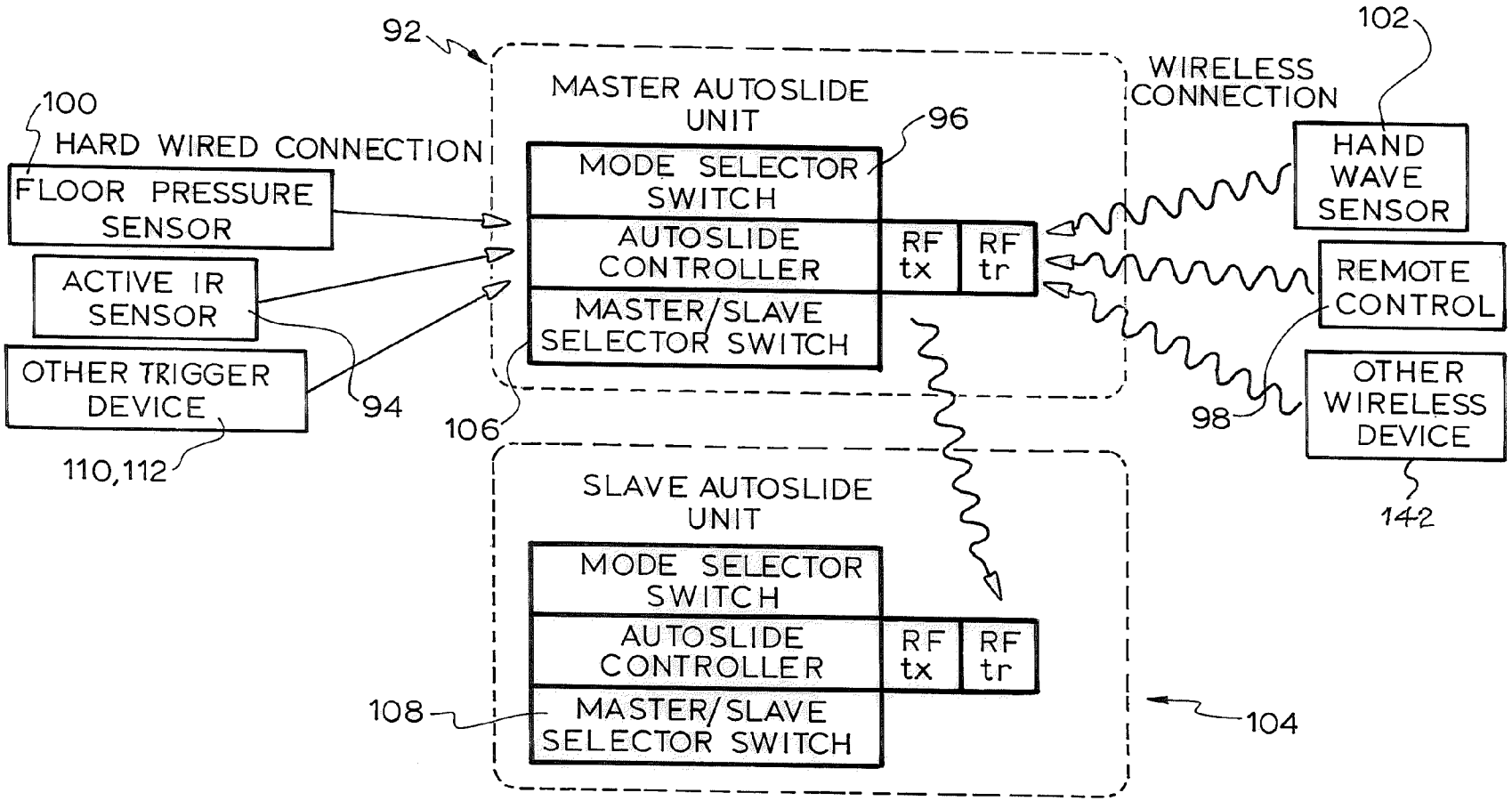
FIG. 10 is a schematic diagram of two coding devices.

Referring to FIG. 10, the driver 14 is operatively connected to a remotely controllable coding device 92. The coding device 92 is capable of causing the door 12 to operate in one of four modes. The first (automatic) mode involves the sliding door operating in response to one or more sensors located internally and/or externally of the door opening. The second (lock) mode involves locking the door 12 in a closed position by way of an internal locking mechanism. It is envisaged that the internal locking mechanism may form an integral part or be associated with the motor. The locking mechanism is controllable remotely by the remote control unit. The third (hold open) mode involves maintaining the door 12 in an open position. The fourth (pet) mode involves enabling the coding device to respond to presence of a pet thereby causing the sliding door 12 to operate in the one or more states. In this event, the coding device may be programmed to associate with a sensor 94 thereby being responsive to a heat radiating object approaching or within a range detectable by the sensor 94. The coding device 92 has a mode selector switch 96 which may be switched on or off either manually or by a remote control device 98.

It is contemplated that the sensor 94 is capable of detecting or responding to a heat radiating object which is in motion or idling or stationery. This is advantageous as, for instance, a pet may stand still at the entrance to an area. The range is defined by one or more beams emitted from the sensor 94 covering a selected area. Also, it is contemplated that other types of sensors such as floor pressure sensors 100, active IR detectors and motion sensors 102 may be associated with the coding device 92.

The driving system 10 is designed so that it can be retrofitted onto an existing sliding door and transferred easily onto a fly screen, for example, for summer, and then subsequently transferred back to the original door as desired.

Furthermore, as shown in FIG. 10, the coding device 92 can be associated with another coding device 104 connected to another movable object. This is most suitable for, for example, a patio door which is accompanied by a fly screen. Both of the coding devices 92, 104 are configured such that they are capable of being set to operate in a master and slave arrangement. As such, motions of the patio door 12 and a complementary fly screen (not shown) may be synchronised. The master and slave arrangement can be activated and deactivated manually by using the respective switches 106 and 108, or electronically by using the remote control device 98. In operation, a one way communication channel is established between the emitter in the master and receiver in the slave for the transmission of commands.

It should be appreciated that in order to ensure that the door operation remains in sync, all sensors and remote controls used to trigger the door and fly screen are associated either by wireless communication or hard-wired interface with the master coding device 92 and the 'open' and 'close' commands are all controlled by the master.

Figure 11:
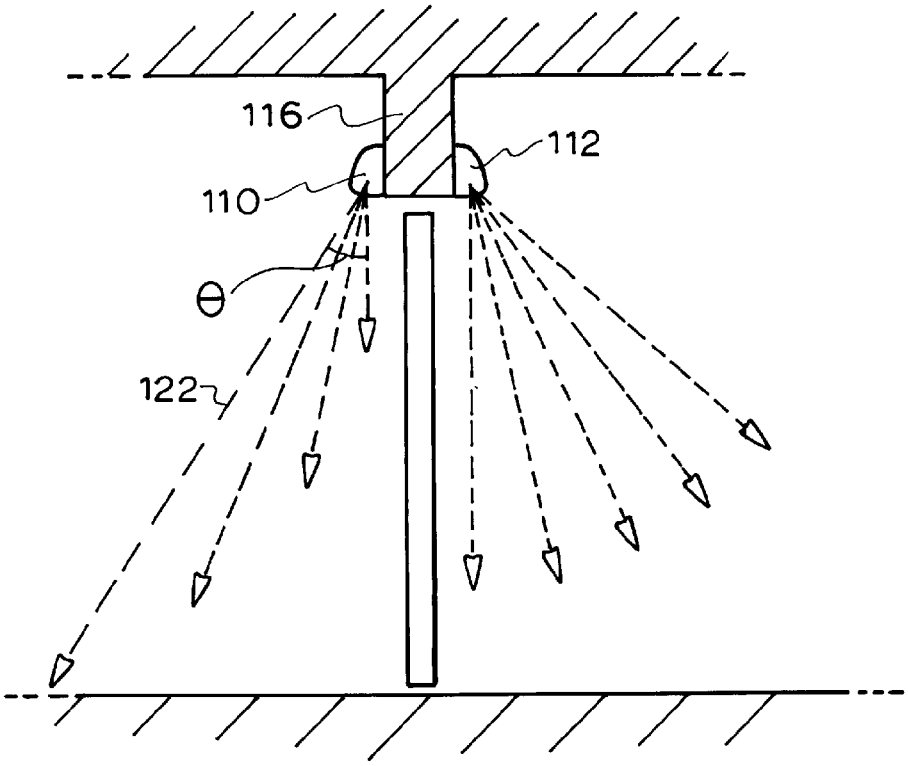
FIG. 11 is a side view illustrating two activators associated with the driving system of FIG. 1 in operation.
Figure 12:
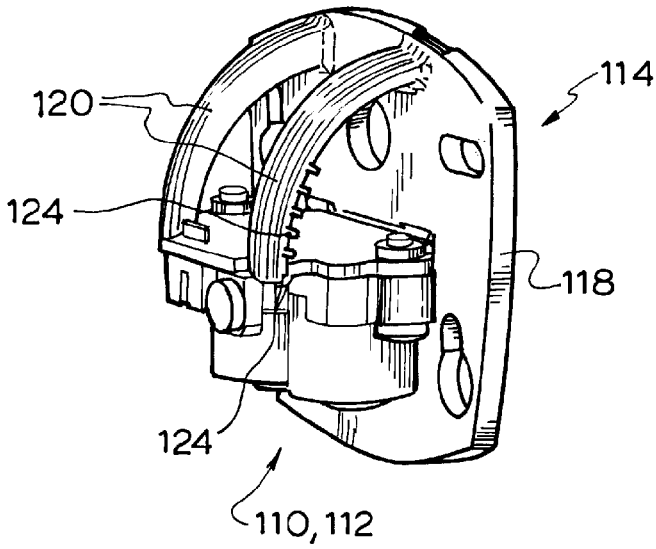
FIG. 12 is a perspective of a holder adapted to carry the activator of FIG. 11.

Referring to FIGS. 11 and 12, the coding device 92 is designed to respond to an activator 110 including an infrared (IR) emitter for emitting an IR beam 122 to an object and a sensor adapted to detect a reflected beam from the object. Each of the activators 110, 112 is movably connected to a holder 114 (FIG. 12) affixed to a wall 116 (FIG. 11). The holder 114 includes a back plate 118 and a pair of curved ratchet bars 120 extending therefrom.

As shown in FIG. 11, the emitting angle θ of the IR beam 122 is adjustable being dictated by the orientation of the activator 110, 112, thereby defining an area of operation. The movement of the activator 110, 112 is coordinated with the pair of ratchet bars 120 and may be effected manually or electronically. The activator 110, 112 is locked at a desired position by a selected pair of sloping teeth 124 provided on the ratchet bars 120. When a vertical beam angle is used (i.e. when θ is at zero degree), the activator 110, 112 will maintain a constant trigger whenever an obstacle is present in the doorway thereby creating a 'safety curtain' preventing the door from closing on any obstacles.

Figure 13:
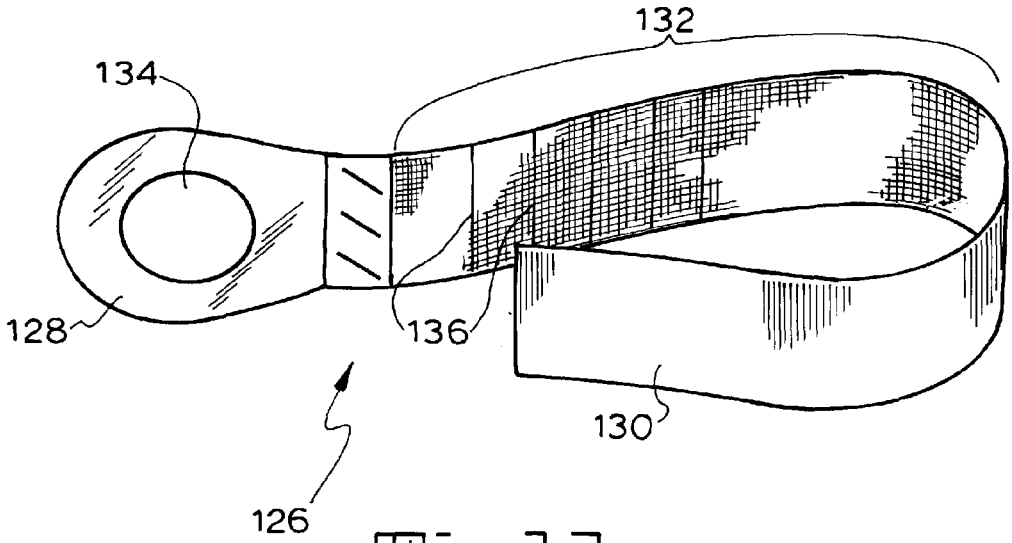
FIG. 13 is a perspective view of an embodiment of a device of the second aspect of the invention, for indicating whether the driving system is suitable for driving a sliding door.

Turning to FIG. 13, device 126 is in the form of a belt for indicating whether a driving system is suitable for driving a sliding door. The belt 126 includes a first end 128, a second end 130 and a region 132 being located between the first end and the second end. The first end 128 has a loop 134 configured to be held by a user. The region 132 has a number of calibrations 136 only some of which are labeled. The second end 130 may be selectively and detachably attached to a selected one of the calibrations 136. The calibrated region 132 is fabricated of a looped portion of VELCRO™. A hooked portion of VELCRO™ is fixed to the second end 130. This arrangement may however be reversed.

Figure 14:
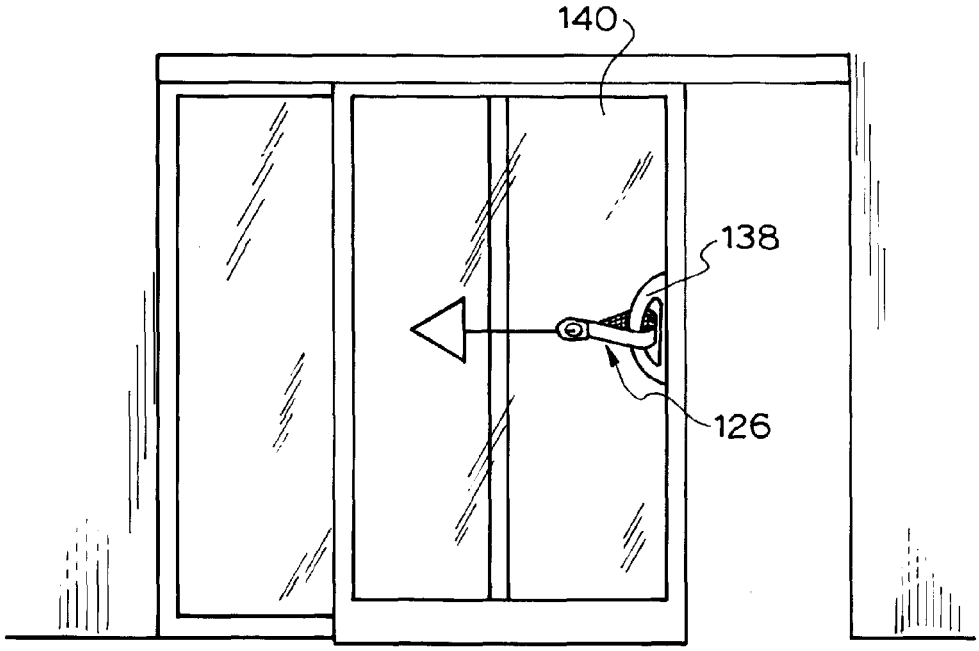
FIG. 14 is a front view of the device of FIG. 13 applied to a sliding door.

Referring to FIG. 14, in use, the user first attaches the belt 126 to an attachment means in the form of a handle 138 of the door 140. The second end 130 is then attached to a desired calibration. The user then uses the first end 128 to pull the door 140 in a selected direction. If the second end 130 detaches from the desired calibration during this procedure, this is an indication that the driving system which can cope with the loads indicated by the selected calibration is not suitable for driving the sliding door 140, either because the door 140 is too heavy or there is too much friction in the system. In such a case, the user may select a heavier duty driving system or have the system serviced, for example.

Now that several preferred embodiments of the present invention have been described in some detail, it will be apparent to those skilled in the art that the driving system and the indicating device may offer at least the following advantages:

1. it is simple and easy to install and apply;
2. it can be installed into many sliding doors regardless of their style and sliding direction;
3. it can enable synchronized opening and closing of a patio door and flyscreen;
4. it can allow easy selection of detection areas;
5. the indicating device may prevent overloading or improper selection of a driving system.

Those skilled in the art will appreciate that the invention described herein is susceptible to variations and modifications other than those specifically described. All such variations and modifications are to be considered within the scope and spirit of the present invention the nature of which is to be determined from the foregoing description.

The invention claimed is:

1. A driving system in combination with an automatic sliding door, the driving system including:

at activator including an infrared (IR) emitter that emits an IR beam to an object and a sensor that detects a reflected beam from the object, the activator connected to a holder that is movable with respect to the holder, wherein the holder includes aback plate and a pair of ratchet bars extending therefrom and is affixed to a door guard, wall or ceiling;

a remotely controllable device that responds to the activator;

a driver operatively connected to the remotely controllable device, wherein the driver is attached to a door frame in either one of two locations, a first location in which the driver is substantially aligned with a first edge of the sliding door and a second location in which the driver is substantially aligned with a second edge of the sliding door, the second edge being opposite the first edge; and a pinion that slides the door in a first or second direction when operatively connected to a corresponding rack associated with the door, the pinion attached to the driver in two positions:

(a) a first position such that the pinion slides the door in the first direction; and (b) a second position such that the pinion slides the door in the second direction.

2. The driving system of claim 1, wherein the door is made of a panel having an upper portion or glass pane framed by a top rail and two side stiles.

3. The driving system of claim 2, wherein the upper portion of the panel or the top rail of the glass pane is adapted to be held in place by a fixed guard.

4. The driving system of claim 2, wherein the rack is adapted to be connected to the upper portion of the panel or the top rail of the glass pane via a connector.

5. The driving system of claim 4, wherein the connector is a channel adapted to span a gap between the door and the driver.

6. The driving system of claim 5, wherein the channel is L-shaped in cross section having an open-ended elongate cavity.

7. The driving system of claim 5, which includes one or more caps adapted to fit onto one or more ends of the channel.

8. The driving system of claim 7, wherein the or each cap includes at least one hole for receiving a fixing means.

9. The driving system of claim 4, which includes a member adapted to fit onto the connector.

10. The driving system of claim 9, wherein the member is adapted to bridge a gap between a lower end of the driver and the door.

11. The driving system of claim 2, wherein the door is a patio door having a frame with a short top rail, and the rack is affixed to the side stiles or one or more grab stiles which extend from the side stiles.

12. The driving system of claim 1, wherein the driver includes a motor and a gearbox.

13. the driving system of claim 1, wherein the second direction is a reverse of the first direction.

14. The driving system of claim 1, wherein the remotely controllable device is capable of causing the sliding door to operate in any selected one of the following four modes: a first mode wherein the sliding door is adapted to operate in response to one or more sensors; a second mode wherein the sliding door is adapted to move to a closed position; a third mode wherein the sliding door is adapted to be maintained in an open position; and a fourth mode wherein the device is adapted to respond to presence of an object thereby causing the sliding door to operate in the one or more of the first, second and third mode.

15. The driving system of claim 1, wherein the remotely controllable device is associated with a second remotely controllable device connected to another movable object.

16. The driving system of claim 15, wherein the remotely controllable device and the remotely controllable second device constitute a master device and a slave device, a one-way communication channel is established between an emitter in the master device and a receiver in the slave device for transmission of commands for effecting synchronized movement of the sliding door and the other movable object.

17. The driving system of claim 1, wherein the IR beam is emitted at an emitting angle dictated by the orientation of the activator thereby defining an area of operation.

18. The driving system of claim 1, wherein the activator is adapted to be locked at a desired position by a selected pair of sloping teeth provided on the ratchet bars.

* * * * *